US008655475B2

(12) United States Patent
Shan et al.

(10) Patent No.: US 8,655,475 B2
(45) Date of Patent: Feb. 18, 2014

(54) THREE-DIMENSIONAL WEAVE-FORMING EQUIPMENT FOR COMPOSITES

(75) Inventors: Zhongde Shan, Beijing (CN); Feng Liu, Beijing (CN); Liu Li, Beijing (CN); Zhilin Lin, Beijing (CN)

(73) Assignee: Advanced Manufacture Technology Center, China Academy of Machinery Science & Technology, Beijing (CN)

( * ) Notice: Subject to any disclaimer, the term of this patent is extended or adjusted under 35 U.S.C. 154(b) by 0 days.

(21) Appl. No.: 13/635,417

(22) PCT Filed: Aug. 16, 2010

(86) PCT No.: PCT/CN2010/076020
§ 371 (c)(1),
(2), (4) Date: Oct. 11, 2012

(87) PCT Pub. No.: WO2011/113254
PCT Pub. Date: Sep. 22, 2011

(65) Prior Publication Data

US 2013/0166058 A1 Jun. 27, 2013

(30) Foreign Application Priority Data

Mar. 16, 2010 (CN) ..... 2010 1 0125069

(51) Int. Cl.
*G06F 19/00* (2011.01)

(52) U.S. Cl.
USPC ..... 700/140; 139/11

(58) Field of Classification Search
USPC ..... 700/140, 141; 139/1 R, 11, DIG. 1
See application file for complete search history.

(56) References Cited

U.S. PATENT DOCUMENTS

| | | | | |
|---|---|---|---|---|
| 3,955,602 | A * | 5/1976 | King | 139/11 |
| 4,936,186 | A * | 6/1990 | Sekido et al. | 87/8 |
| 5,987,929 | A * | 11/1999 | Bostani | 66/1 R |

FOREIGN PATENT DOCUMENTS

| | | | |
|---|---|---|---|
| CN | 1614114 | A | 5/2005 |
| CN | 201151798 | Y | 11/2008 |
| CN | 101586285 | A | 11/2009 |
| DE | 19709105 | C1 | 8/1998 |
| JP | 1148863 | A | 6/1989 |
| KR | 20090132083 | A | 12/2009 |

OTHER PUBLICATIONS

P.R. China, State Intellectual Property Office, International Search Report for International Application No. PCT/CN2010/076020, mailed Dec. 23, 2010.

* cited by examiner

*Primary Examiner* — Nathan Durham
(74) *Attorney, Agent, or Firm* — Bright IP Law Offices

(57) ABSTRACT

A three-dimensional weave forming equipment for composites mainly comprises a main body portion and a specific numerical control software for three-dimensional weaving process. The main body portion comprises a movement system for a controllable digital template, a movement system for a pickup device and a movement control system for a guiding sleeve. Compared with the existing three-dimensional weave-forming equipment, the three-dimensional weave-forming equipment for composites is highly automatic. Products made by the equipment are smooth at inner and outer surfaces, and have advantages of high precise dimension, low porosity and stable performance. And it can be reinforced partially and have directional property according to requirements of design. So problems of simple cross-section of the finished part and too much pores in the products, which manufactured by the existing three-dimensional weave forming equipment are solved. The three-dimensional weave forming equipment for composites is especially suitable for producing products with large dimension and complex external structure.

4 Claims, 2 Drawing Sheets

THREE-DIMENSIONAL WEAVE-FORMING EQUIPMENT FOR COMPOSITES

CROSS REFERENCE TO RELATED APPLICATIONS

This application is the U.S. National Stage of International Patent Application No. PCT/CN2010/076020 filed on Aug. 16, 2010, which claims priority to Chinese Patent Application No. 201010125069.9 filed on Mar. 16, 2010. Both the PCT Application and Chinese Application are hereby incorporated by reference in their entirety.

TECHNICAL FIELD OF THE INVENTION

The invention relates to a three-dimensional weave-forming equipment for composites, and belongs to the intersection field of textiles and manufacturing.

BACKGROUND OF THE INVENTION

For light weight, excellent abrasion resistance, strong toughness and other excellent performances, composites are adapted to wide engineering requirements, and the specific strength, the specific modulus and the heat resistance of the composite materials are superior over those of the matrix metals, therefore playing an important role in the development of advanced technology fields such as aerospace, and attracting worldwide attention increasingly. Three-dimensional weaving technology is called one of the most advanced manufacturing technologies for composites worldwide at present. Internationally, load-bearing beams and joints in various shapes in devices such as aircrafts and automobiles have been manufactured successfully by the three-dimensional weaving technology for composites. With such technology, artificial bones, artificial ligaments and bone fracture plates and the like have even been manufactured in the terms of artificial biological tissues. In recent years, with the rapid development of the aerospace industry and the national defense industry or the like in China, requirements on the weaving technology for composites have been higher, and the demand of manufacturing bearing structure parts by the direct forming of composite materials becomes higher.

Products made by the traditional two-dimensional layered weaving equipment have some disadvantages which is hard to overcome: for example, the overall structure of the product is simple, both the rigidity and the strength in the thickness direction are low, the strength of in-plane shear and inter laminar shear is low, it is easy to delaminate, and both the impact toughness and the damage tolerance level are low, so that they cannot meet the performance requirements of main bearing structure parts. In recent years, the developed countries have been committed to develop novel weaving equipment to realize mass production of three-dimensional weaving preforms. In 1971, General Electric in the United States invented a three-dimensional weaving machine named of 'Omniweave'. From then on, weaving machines have been developed in the trend of mechanization, automation and micro-computerization, and CAD/CAM integration was realized initially. The North Carolina State University in the United States developed a full-automatic continuous yarn-feeding weaving machine, which is the first full-automatic weaving machine in the world. In China, relevant researches on the optimization and improvement of three-dimensional weaving process and weaving equipment have also been carried out. The Tianjin Polytechnic University, the Nanjing University of Aeronautics and Astronautics, the East China Institute of Technology and the National University of Defense Technology and the like have developed three-dimensional weaving machines, some of which can three-dimensionally weave the products in relatively simple shape. However, the working efficiency is low, and there is still a pronounced gap compared with the advanced level in the world. And most three-dimensional weaving machines are obtained by modifying the traditional looms.

Although products woven by the existing advanced three-dimensional weave-forming equipment at home or abroad have been greatly improved in aspects of structure shape, delimination and mechanical property and the like, there are still the following shortcomings: (1) the structure of products made by the equipments is still simple, and for preforms with complex shape, it is necessary to change the layout or quantity of fibers during weaving, resulting in that the processing procedure is complex, and it is hard to realize automation control; (2) the existing advanced three-dimensional weave-forming equipment are not suitable for processing preforms with large dimension; (3) the effect of dipping fibers with resin is not so ideal and the porosity is high, and as a result, the mechanical property, the weather resistance and the fatigue life of products are decreased.

SUMMARY OF THE INVENTION

The invention mainly provides a three-dimensional weave-forming equipment for composites.

The following technical solution is employed in the invention to solve the three-dimensional weaving technical problem:

A three-dimensional weave-forming equipment for composites comprises a workbench; a controllable digital template arranged on the workbench; guiding poles, one end of each of which is arranged on the controllable digital template; the controllable digital template can reciprocate along the vertical direction; guiding sleeves, which are wound on sleeve spindles and after passing through guiding sleeve tensioning devices, pass through the hollow guiding poles, and are evaginated, and then fixed on the controllable digital template, wherein the smooth wall of the outer surface of the evaginated guiding sleeves abuts against the outer wall of the guiding poles tightly, and the threaded inner surface of the evaginated guiding sleeves are wound with filaments, so as to realize the longitudinal locking of the part; spools, which are arranged on the lateral side of a frame, wherein filaments on the spools after being tensioned by filament tensioning devices on needle holders, passes through weaving needles, and the needle holders are arranged on the frame; a weaving needle pickup device which is arranged on the frame, wherein the weaving needle pickup device is driven by an X-axis motor and a Y-axis motor to fetch weaving needles and then weave along a preset path in the plane of X and Y.

The technical solution employed in the invention to solve the technical problem can be further improved. The controllable digital template controls the guiding poles to be selectively distributed and ascended or descended in the vertical direction according to the overall dimension and the requirements on structure and performance of the parts. The guiding poles are of hollow tubular structures smooth at inner and outer surfaces. The guiding sleeve is one or more filaments with the zigzag surface or hollow soft sleeve, and the shape of the inner surface is determined according to the structure feature of the parts to be woven, the shape of the inner surface is of a thread shape and zigzag shape or the like, and the outer surface is smooth. The guiding poles are of hollow structures, allowing the hollow guiding sleeve passing through the inside thereof. Filaments of specific materials can pass through the inside of the guiding sleeves according to the performance requirements of the parts. The finished component is sewed and bound locally or integrally. Plural sets of weaving needle pickup devices may be arranged on the frame simultaneously to weave simultaneously.

The invention has the following advantageous effects: the automation level of the equipment is high, the weaving paths are various and controllable, parts with large dimension and complex overall structure can be processed according to their overall dimensions, structure requirements and performance requirements: the finished products have smooth surfaces and high impact resistance, anti-cracking and anti-fatigue and forming precision, and the preparation and the forming of the composites are integrated.

BRIEF DESCRIPTION OF THE DRAWINGS

The specific embodiments of the invention will be described in detail below with reference to drawings.

REFERENCE NUMBERS

Figure 1:
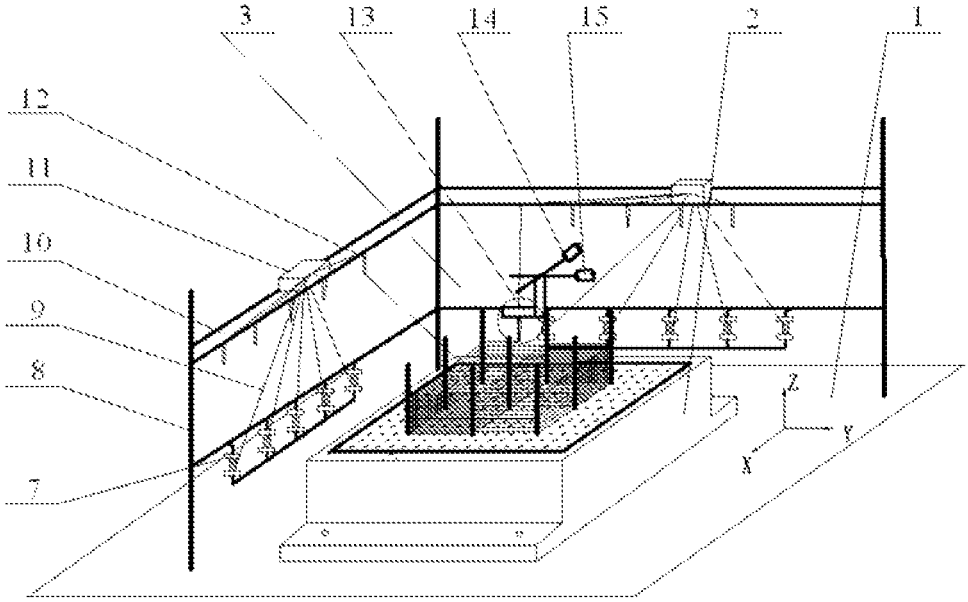
FIG. 1 shows a schematic diagram of the three-dimensional weave forming equipment for composites according to the present invention.
Figure 2:
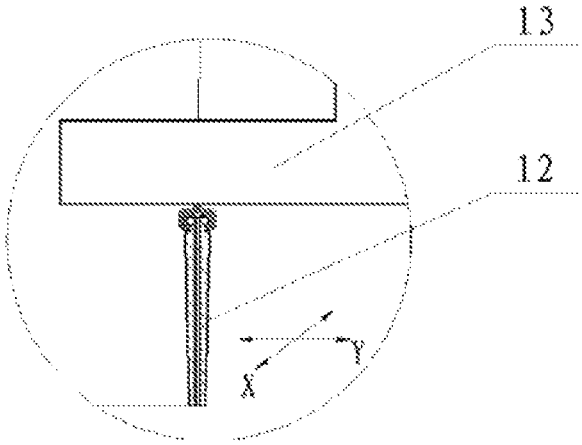
FIG. 2 shows a sectional view of the weaving needle.
Figure 3:
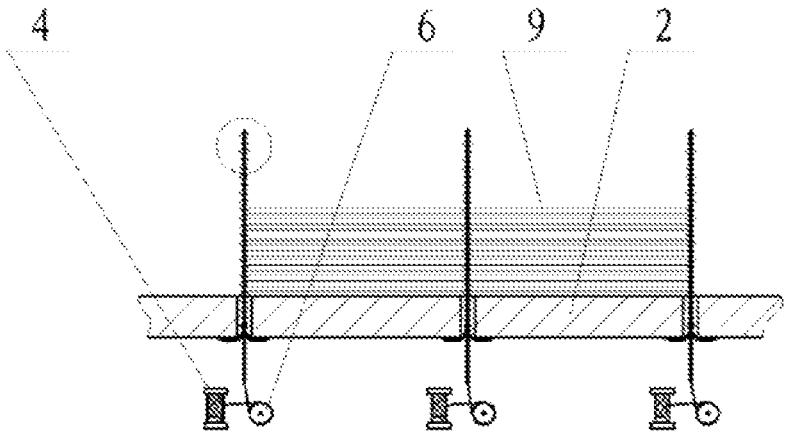
FIG. 3 shows a local sectional view of the three-dimensional weave forming equipment for composites according to the present invention.
Figure 4:
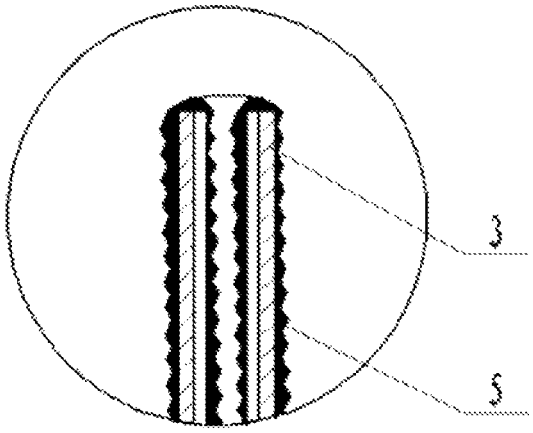
FIG. 4 shows the local sectional view of the three-dimensional weave forming equipment for composites according to the present invention.

1. workbench, 2. controllable digital template, 3. guiding pole, 4. sleeve spindle, 5. guiding sleeve, 6. guiding sleeve tensioning device, 7. spool, 8. frame, 9. filament, 10. needle holder, 11. filament tensioning device, 12. weaving needle, 13. pickup device, 14. X-axis motor, 15. Y-axis motor.

DETAILED DESCRIPTION OF THE INVENTION

The invention will be further described below with reference to embodiments. The three-dimensional weave forming equipment for composites comprises a workbench 1; a controllable digital template 2 arranged on the workbench 1; guiding poles 3, one end of each of which is arranged on the controllable digital template 2, wherein the guiding pole 3 is of hollow tubular structure and has smooth inner and outer surfaces and the controllable digital template 2 can reciprocate along the vertical direction, which controls the guiding poles 3 to be selectively distributed and ascended or descended in the vertical direction according to the overall dimension and the structure and performance requirements of the elements; guiding sleeves 5 wound on sleeve spindles 4, which after passing through guiding sleeve tensioning devices 6, passed through the hollow guiding poles 3 and are evaginated, and then are fixed on the controllable digital template 2, wherein, the smooth wall of the outer surface of the evaginated guiding sleeve 5 abuts against the outer wall of the guiding pole 3 tightly, and the threaded inner surface of the evaginated guiding sleeve 5 is wound with filaments, to realize the longitudinal locking of the part, wherein the guiding sleeve 5 may be one or more filaments with zigzag surface or hollow soft sleeve, wherein the shape of the inner surface is determined according to the structure feature of the part to be woven, capable of being a thread shape, zigzag shape or the like; spools 7 which are arranged on the lateral side of a frame 8, wherein filaments 9 on the spools 7, after being tensioned by filament tensioning devices 11 on needle holders 10, pass through weaving needles 12 and the needle holders 10 are arranged on the frame 8; a weaving needle pickup device 13 which is arranged on the frame 8, wherein the weaving needle pickup device 13 is driven by an X-axis motor 14 and a Y-axis motor 15 to fetch weaving needles 12 and then can weave along the preset path in the plane of X and Y. The structure of the weaving needles 12 is in a form of hollow tubular or a sewing needle.

The method for operating the equipment is as follows: according to the layered design structure of the part, parameters, such as the corresponding series of the guiding poles 3 (diameter, height and material and the like) and the outer surface shape of the guiding sleeves 5, are selected; on the controllable digital template 2 the guiding poles 3 are distributed and the effective weaving height of the guiding poles are adjusted according to the preset program, the guiding sleeves 5 wound on the sleeve spindles 4, after passing through the guiding sleeve tensioning devices 6, passed through the hollow guiding poles 3 and evaginated, and then fixed on the controllable digital template 2, wherein the smooth wall of the outer surface of the evaginated guiding sleeves 5 abuts against the outer wall of the guiding poles 3 tightly, and the threaded inner surface of the evaginated guiding sleeves 5 is wound with filaments, to realize the longitudinal locking of the part; a row of needle holders 10 are arranged on each of the two sides of the frame 8 in directions X and Y. The standby weaving needles 12, through which filaments 9 already passed, are on the needle holders 10. The pickup device 13 fetches one or more weaving needles 12 in the direction X to weave the inside of the layer and the outer profile according to the preset layer grid filling mode, to finish the weaving and filling in this direction. The pickup device 13 fetches one or more weaving needles 12 in the direction Y to weave the inside of the layer and the outer profile in the same way. After this layer is woven and filled, the controllable digital template 2 moves downwards a preset distance, and at this time, the fixed guiding poles 3 move upwards with respect to the controllable digital template 2, and the guiding sleeves 5 sleeved over the guiding poles 3 are drawn for feeding filaments and are tensioned under the action of the guiding sleeve tensioning devices 6. The equipment continuously repeats above steps to finish the weaving of the part. Afterwards, the guiding poles 3 move downward until their top end is submerged into the controllable digital template 2, and then the part woven can be taken out.

Above contents just describe preferred embodiments of the invention. It should be noted that, for one skilled in the art, the invention may have various improvements, embellishments or changes without departing the principle of the invention, and these improvements, embellishments or changes should be included within the protection scope of the invention.

What is claimed is:

1. A three-dimensional weave forming equipment for composites, comprising: a workbench (1); a controllable digital template (2) arranged on the workbench (1); guiding poles (3), one end of each of which is arranged on the controllable digital template (2); wherein the controllable digital template (2) can reciprocate along the vertical direction; guiding sleeves (5), which are wound on sleeve spindles (4) and after passing through guiding sleeve tensioning devices (6), pass through the hollow guiding poles (3) and are evaginated, and then fixed on the controllable digital template (2), wherein the smooth wall of the outer surface of the evaginated guiding sleeves (5) abuts against the outer wall of the guiding poles (3) tightly, and the inner surface of the evaginated guiding sleeves (5) are wound with filaments, so as to realize the longitudinal locking of the part; spools (7), which are arranged on the lateral side of a frame (8), wherein filaments (9) on the spools (7) after being tensioned by filament tensioning devices (11) on needle holders (10), passes through weaving needles (12), and the needle holders (10) are arranged on the frame (8); a weaving needle pickup device (13) which is arranged on the frame (8), wherein the weaving needle pickup device (13) is driven by an X-axis motor (14) and a Y-axis motor (15) to fetch weaving needles (12) and then weave along a preset path in the plane of X and Y.

2. The three-dimensional weave forming equipment for composites according to claim 1, wherein the controllable digital template (2) controls the guiding poles (3) to be selectively distributed and ascended or descended in the vertical direction according to the overall dimension and the requirements on structure and performance of the parts.

3. The three-dimensional weave forming equipment for composites according to claim 1, wherein the guiding sleeve (5) is one or more filaments with zigzag surface or hollow soft sleeve, wherein the shape of the inner surface is determined according to the structure feature of the parts to be woven, the shape of the inner surface is of a thread shape or zigzag shape, and the outer surface is smooth.

4. The three-dimensional weave forming equipment for composites according to claim 1, wherein the structure of the weaving needles (12) is in a form of hollow tubular or sewing needle.

* * * * *